US009327157B1

(12) United States Patent
Miller

(10) Patent No.: US 9,327,157 B1
(45) Date of Patent: May 3, 2016

(54) MANUALLY CONTROLLED AND DRIVEN RESISTANCE EXERCISE MACHINE

(71) Applicant: Waide Lee Miller, Lake Zurich, IL (US)

(72) Inventor: Waide Lee Miller, Lake Zurich, IL (US)

( * ) Notice: Subject to any disclaimer, the term of this patent is extended or adjusted under 35 U.S.C. 154(b) by 0 days.

(21) Appl. No.: 14/591,369

(22) Filed: Jan. 7, 2015

(51) Int. Cl.
*A63B 21/002* (2006.01)
*A63B 21/00* (2006.01)
*A63B 21/28* (2006.01)

(52) U.S. Cl.
CPC ..... *A63B 21/0023* (2013.01); *A63B 21/002* (2013.01); *A63B 21/28* (2013.01)

(58) Field of Classification Search
CPC ..... A63B 21/00069; A63B 21/00072; A63B 21/00076; A63B 21/00178; A63B 21/00185; A63B 21/002; A63B 21/0023; A63B 21/08; A63B 21/151; A63B 21/153; A63B 21/28; A63B 21/285; A63B 2225/102
See application file for complete search history.

(56) References Cited

U.S. PATENT DOCUMENTS 4,863,163 A * 9/1989 Wehrell ..... A63B 21/4009 482/123
7,364,538 B2 * 4/2008 Aucamp ..... A63B 21/154 482/131
9,199,110 B2 * 12/2015 Jones ..... A63B 5/16

* cited by examiner

*Primary Examiner* — Oren Ginsberg
(74) *Attorney, Agent, or Firm* — Justin Lampel

(57) ABSTRACT

A manually controlled and driven resistance exercise machine is provided. The exercise machine enables a user to stimulate his/her muscles by various concentric, isometric and/or eccentric exercises. The machine has a generally horizontal platform and a vertical tower wherein both the generally horizontal platform and the vertical tower have an interior which contain a rope, gears and/or a pulley. A second person manually controls the resistance and velocity of the rope by controlling a crank or wench on the vertical tower. The person exercising consistently pushes up on the bar, handles, straps, hooks or the like while the second person alters the downward force of the bar, handles, straps, hooks or the like by controlling the crank or wench.

11 Claims, 5 Drawing Sheets

MANUALLY CONTROLLED AND DRIVEN RESISTANCE EXERCISE MACHINE

BACKGROUND OF THE INVENTION

A manually controlled and driven resistance exercise machine is provided. The exercise machine enables a user to safely and meaningfully stimulate his/her muscles by various concentric, isometric and/or eccentric exercises. The machine has a generally horizontal platform and a vertical tower wherein both the generally horizontal platform and the vertical tower have an interior which contain a rope, gears and/or a pulley. The rope engages the gears and/or pulley of the interior of the generally horizontal platform and then extends up through an opening of the platform so that a person exercising, training, conditioning or undergoing rehabilitation pushes upward on a bar, handles, straps, hooks or the like secured to the rope. A second person manually controls the resistance and velocity of the rope by controlling a crank or wench on the vertical tower. The person exercising consistently pushes up on the bar, handles, straps, hooks or the like while the second person alters the downward force of the bar, handles, straps, hooks or the like by controlling the crank or wench. The downward force on the bar, handles, straps, hooks or the like is predominately controlled by the second person and not by gravity (as is used in traditional weight benches or other exercise devices). As a result, the exercise machine is substantially safer than traditional exercise machines in that a user is prevented from dropping a substantial amount of weight on his/her chest while performing, for example, a bench lift.

Over the years, attempts have been made to provide a manually controlled exercise machine. For example, U.S. Pat. No. 7,803,095 to LaGree discloses an exercise machine that enables a user to perform a variety of repetitive exercises in reclined, sitting and standing positions. The machine permits a user to perform exercises not possible on a traditional Pilates Reformer machine. The machine includes a frame with parallel side rails formed of extrusions, with a carriage that is mounted for rolling movement along the frame. A plurality of tension springs are selectively detachable/attachable to the end of the frame, to allow the user to decrease/increase the tension on the carriage. Angularly adjustable crossbars are mounted at both the head and foot ends of the frame, as are stationary platforms for the user's feet and/or hands; in addition, a raised transverse bar is mounted at the head end of the rolling platform. The combination of platforms and bars enables the user to perform a variety of exercises in standing positions. The frame includes legs that raise the side rails above the floor. A barbell rack and storage tray are mounted between the rails so as to be positioned generally beneath the frame, and are accessible vertically through the open space between the rails when the rolling platform is retracted by the springs to the foot end of the assembly.

Further, U.S. Pat. No. 5,447,484 to Chandler discloses an exercise device having a tether rope that extends longitudinally through an elongated rigid tubular member, and terminates in gripping handles that are held by the exercising person while standing upon the tubular member. The tubular member is pivotably mounted at its centerpoint upon holding plates upwardly emergent from the upper surface of a base platform, thereby having see-saw motion in a vertical plane. An elongated aperture is disposed in the upper surface of the base platform to receive the extremities of the tubular member as they are depressed alternately during the exercise activity.

Still further, U.S. Pat. No. 4,787,630 to Watson discloses an exercise device having a rotatably interconnected base and platform assemblies. The base assembly is adapted to rock back and forth on a floor or other horizontal surface and a person using the device stands, sits, kneels or lays on the platform assembly. The device is adjustable whereby the permitted range of movement can be widely varied. Ropes, springs, elastic cords or poles can be grasped by a person using the device for balance and for upper body exercise.

However, these patents fail to describe a manually controlled and driven resistive exercise machine which is easy to use, safe and efficient as is described in the present application. Further, these patents fail to provide a manually operated exercise machine which is controlled by a second person (such as a trainer, healthcare provider or spotter) while a first person (the exercising person) exercises.

SUMMARY OF THE INVENTION

A manually controlled and driven resistance exercise machine is provided. The exercise machine enables a user to safely and meaningfully stimulate his/her muscles by various concentric, isometric and/or eccentric exercises. The machine has a generally horizontal platform and a vertical tower wherein both the generally horizontal platform and the vertical tower have an interior which contain a rope, gears and/or a pulley. The rope engages the gears and/or pulley of the interior of the generally horizontal platform and then extends up through an opening of the platform so that a person exercising, training, conditioning or undergoing rehabilitation pushes upward on a bar, handles, straps, hooks or the like secured to the rope. A second person manually controls the resistance and velocity of the rope by controlling a crank or wench on the vertical tower. The person exercising consistently pushes up on the bar, handles, straps, hooks or the like while the second person alters the downward force of the bar, handles, straps, hooks or the like by controlling the crank or wench. The downward force on the bar, handles, straps, hooks or the like is predominately controlled by the second person and not by gravity (as is used in traditional weight benches or other exercise devices). As a result, the exercise machine is substantially safer than traditional exercise machines in that a user is prevented from dropping a substantial amount of weight on his/her chest while performing, for example, a bench lift.

An advantage of the present exercise device is that the present exercise device is safe in that if the person exercising completely stops pushing upward or otherwise cannot provide proper resistance to a bar, handles, straps, hooks or the like, then the bar, handles, straps, hooks or the like would not be suddenly forced down upon the person exercising as would normally occur in, for example, a free weight bench press.

An advantage of the present exercise device is that the present exercise device requires no external power source.

And another advantage of the present exercise device is that the present exercise device allows a second person (an operator such as a trainer, healthcare provider or spotter) to manually control the resistance and/or velocity of the bar, handles, straps, hooks or the like of the device while the first person (the patient or person exercising) using the exercise device performs the exercise.

Still another advantage of the present exercise device is that the present exercise device has a generally flat horizontal platform portion in which multiple benches, chairs and/or free standing positions may be used.

Another advantage of the present exercise device is that a second person may alter the resistance and/or velocity of the exercise being performed by the first person while the first person is in the act of exercising.

And an advantage of the present exercise device is that the present exercise device may have a tower stabilization handle on the tower portion which helps balance and stabilize the second person (the operator) while the first person (the person exercising) is using the device.

And another advantage of the present exercise device is that the present device allows a user to experience infinite training and/or rehabilitation protocols due to the multi-functionality of the present exercise device.

Another advantage of the present exercise device is that the present device allows for quickly modifying the exercise protocol variables such as concentric loading, isometric loading, eccentric loading, time under tension, etc. all with the same piece of equipment.

Yet another advantage of the present exercise device is that the present exercise device has a plurality of adjustable feet which allows the exercise device to be properly leveled on a floor or allows the user to electively select an incline for the platform.

Still another advantage of the present exercise device is that the present device induces muscular growth in a safe manner.

And another advantage of the present exercise device is that the present exercise device may allow the second person to apply resistance to a bar, handles, straps, hooks or the like at approximately an 18:1 ratio.

For a more complete understanding of the above listed features and advantages of the present manually controlled and driven exercise device reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A manually controlled and driven resistance exercise machine is provided. The exercise machine enables a user to safely and meaningfully stimulate his/her muscles by various concentric, isometric and/or eccentric exercises. The machine has a generally horizontal platform and a vertical tower wherein both the generally horizontal platform and the vertical tower have an interior which contain a rope, gears and/or a pulley. The rope engages the gears and/or pulley of the interior of the generally horizontal platform and then extends up through an opening of the platform so that a person exercising, training, conditioning or undergoing rehabilitation pushes upward on a bar, handles, straps, hooks or the like secured to the rope. A second person manually controls the resistance and velocity of the rope by controlling a crank or wench on the vertical tower. The person exercising consistently pushes up on the bar, handles, straps, hooks or the like while the second person alters the downward force of the bar, handles, straps, hooks or the like by controlling the crank or wench. The downward force on the bar, handles, straps, hooks or the like is predominately controlled by the second person and not by gravity (as is used in traditional weight benches or other exercise devices). As a result, the exercise machine is substantially safer than traditional exercise machines in that a user is prevented from dropping a substantial amount of weight on his/her chest while performing, for example, a bench lift.

Figure 1:
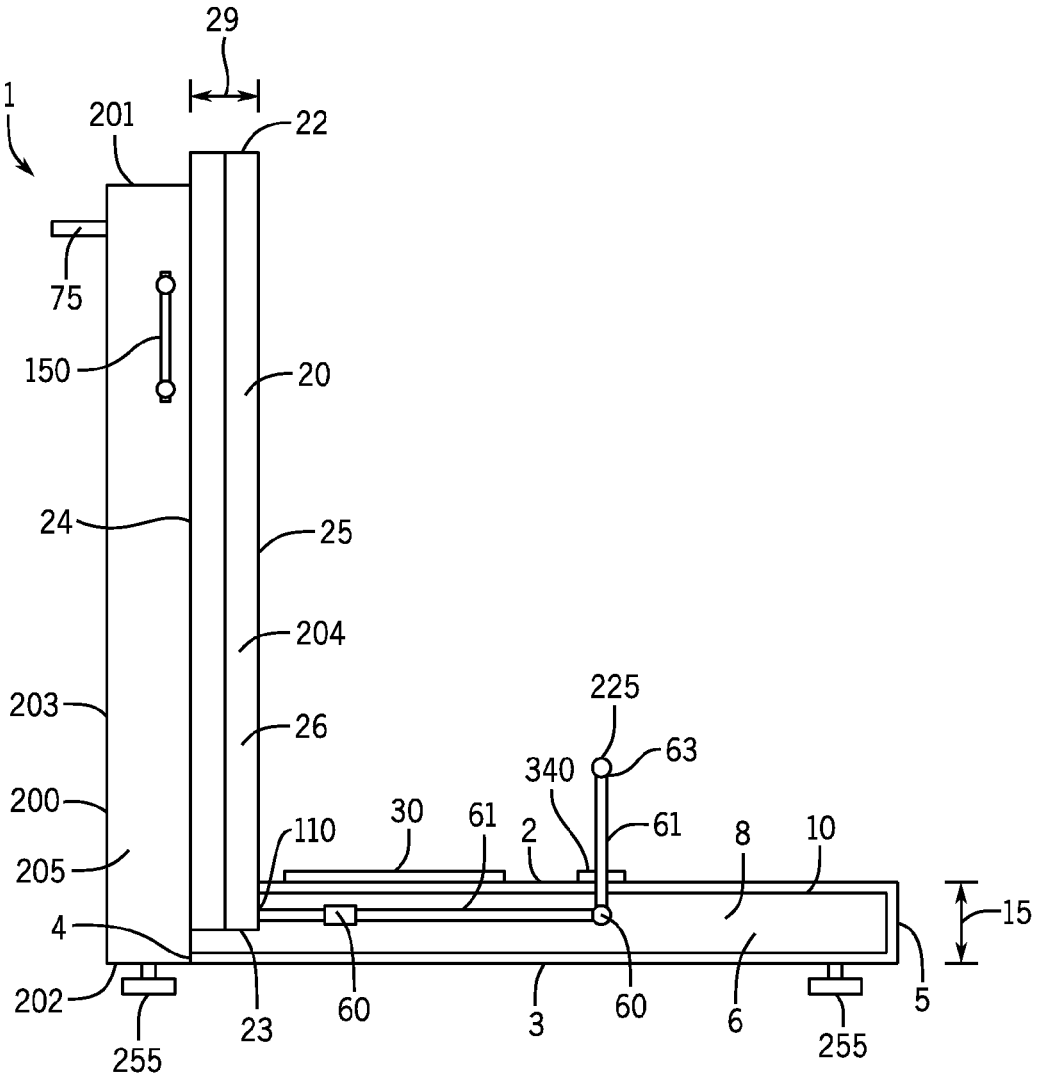
FIG. 1 illustrates a side view of the exercise machine.

Referring first to FIG. 1, in an embodiment, a manually operated exercise machine 1 is provided. The manually operated exercise machine 1 may have a generally horizontal platform portion 10 and a generally vertical tower portion 20. In an embodiment, the generally horizontal platform 10 may have a top 2, a bottom 3, a front 4, a back 5, a first side 6, a second side 7 (FIG. 2) and an interior 8. Preferably the generally horizontal platform portion 10 is durable, capable of supporting the weight of a large person. In particular, the horizontal platform portion 10 may be made of, for example, a durable metal having rubber and/or plastic components.

In an embodiment, the distance from the top 2 of the generally horizontal platform 10 to the bottom 3 of the generally horizontal platform 10 may define a height 15 of the generally horizontal platform 10. Although the height 15 of the generally horizontal platform 10 may vary a great deal, the height 15 is preferably between eight inches and twenty-four inches. In particular, the height 15 should be large enough so that the interior 8 of the generally horizontal platform portion 10 may house and protect internal gears (or pulleys) 60 and ropes (or straps or chains) 61. The term rope 61 or ropes 61 as used throughout this application should not be interpreted as limiting, but instead may include any similar device such as, for example, chains, nylon strappings, cable wires or the like.

Figure 6:
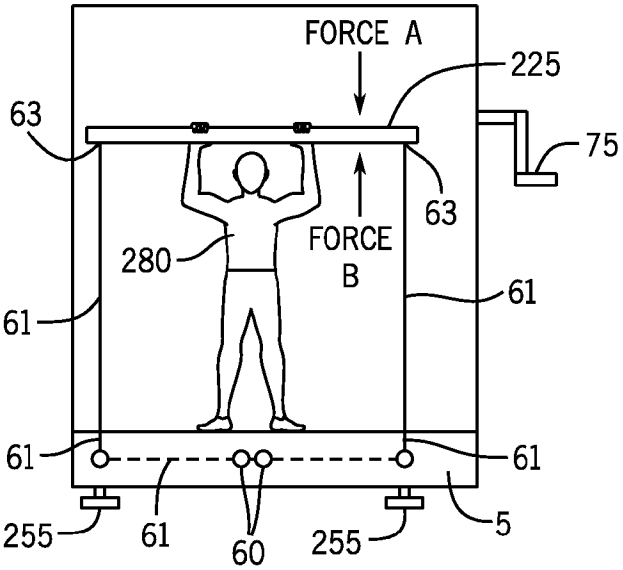
FIG. 6 illustrates a back view of the exercise machine wherein a first person is pushing up on a bar attached to the ropes of the exercise machine.

In an embodiment, the ropes 61 may be secured to a bar, handles, straps, hooks or the like 225 wherein a first person 280 (FIG. 5) applies consistent pressure in pushing upward on the bar, handles, straps, bands, hooks or the like 225 while a second person 275 (the non-exercising person) alters the downward resistance and/or velocity of the bar, handles, straps, hooks or the like 225. The first person 280 may be generally reclined (as shown in FIG. 1) while performing the exercise, may be standing upright (as shown in FIG. 6), may be seated in a chair (not shown) or may be in virtually limitless other positions while exercising on the device 1. In an embodiment, the second person 275 may be, for example, a trainer, healthcare practitioner or spotter who proscribes a workout program to the first person 280 who may be, for example, a patient or merely a person exercising.

Figure 3:
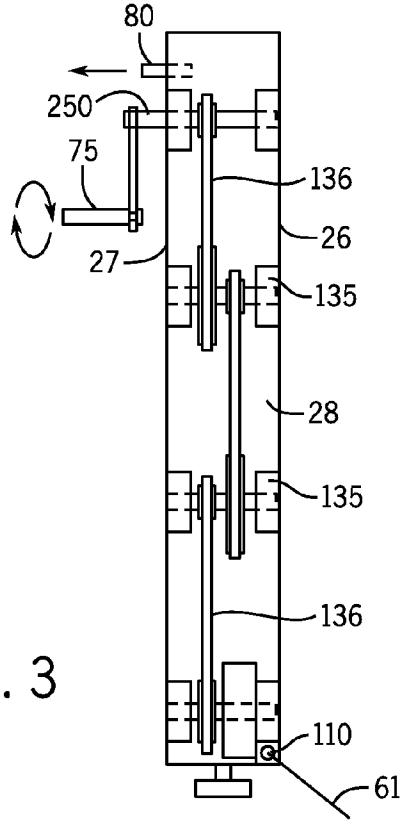
FIG. 3 illustrates a front view of the generally vertical tower of the exercise machine.
Figure 5:
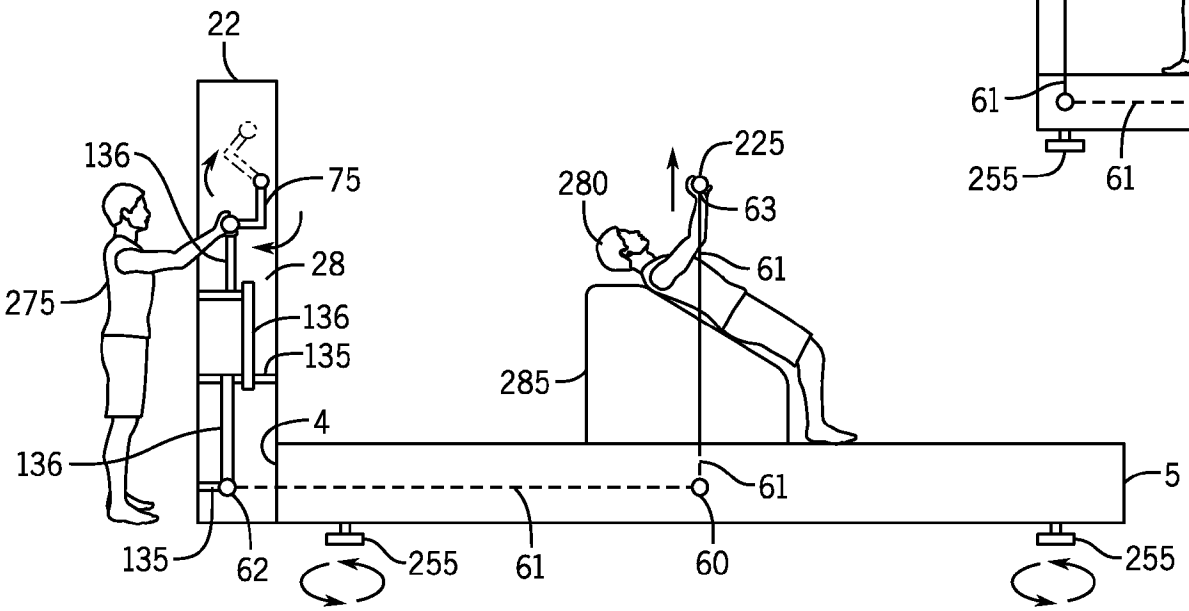
FIG. 5 illustrates a side view of the exercise machine wherein a first person is exercising and wherein a second person is controlling the resistance of the exercise bar while the first person is exercising.

In an embodiment, the generally vertical tower portion 20 may have a top 22, a bottom 23, a front 24, a back 25, a first side 26, a second side 27 (FIG. 3) and an interior 28 (FIGS. 3 and 5). In an embodiment the distance between the front 24 and the back 25 of the generally vertical tower portion 20 may define a width 29. The width 29 of the generally vertical tower portion 20 may be large enough so as to allow for worm/planetary gears 135 (FIG. 3) and belts 136 as described below.

Figure 8:
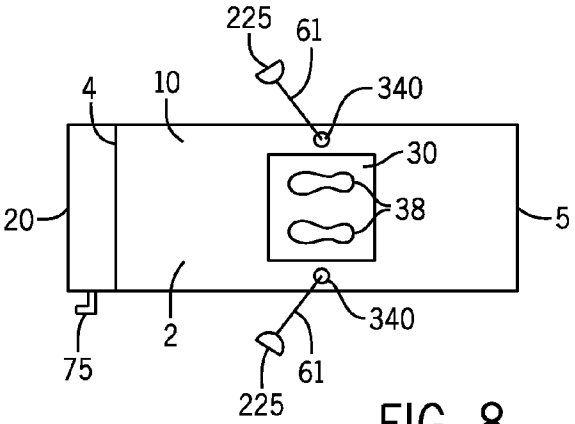
FIG. 8 illustrates a top view of the exercise machine wherein handles are secured to the rope as opposed to an exercise bar (as shown in FIG. 6).

In an alternative embodiment, the top 2 of the generally horizontal platform 10 may have a slip resistant tape 30 (or other rough surface). The slip resistant tape 30 may prevent the first person 280 from slipping on the generally horizontal platform 10 and injuring him/herself. Further, in an embodiment, the top 2 of the generally horizontal platform 10 may have indicia 38 (FIG. 8) indicating the proper position to sit and or stand while using the device 1 for a specific exercise. In FIG. 8, the indicia 38 is an outline of the proper feet orientation although any indicia may be used and/or changed depending on the desired exercise. In an alternative embodiment, the indicia 38 is displayed on an electronic surface which may alter the indicia 38 depending on the exercise.

Figure 2:
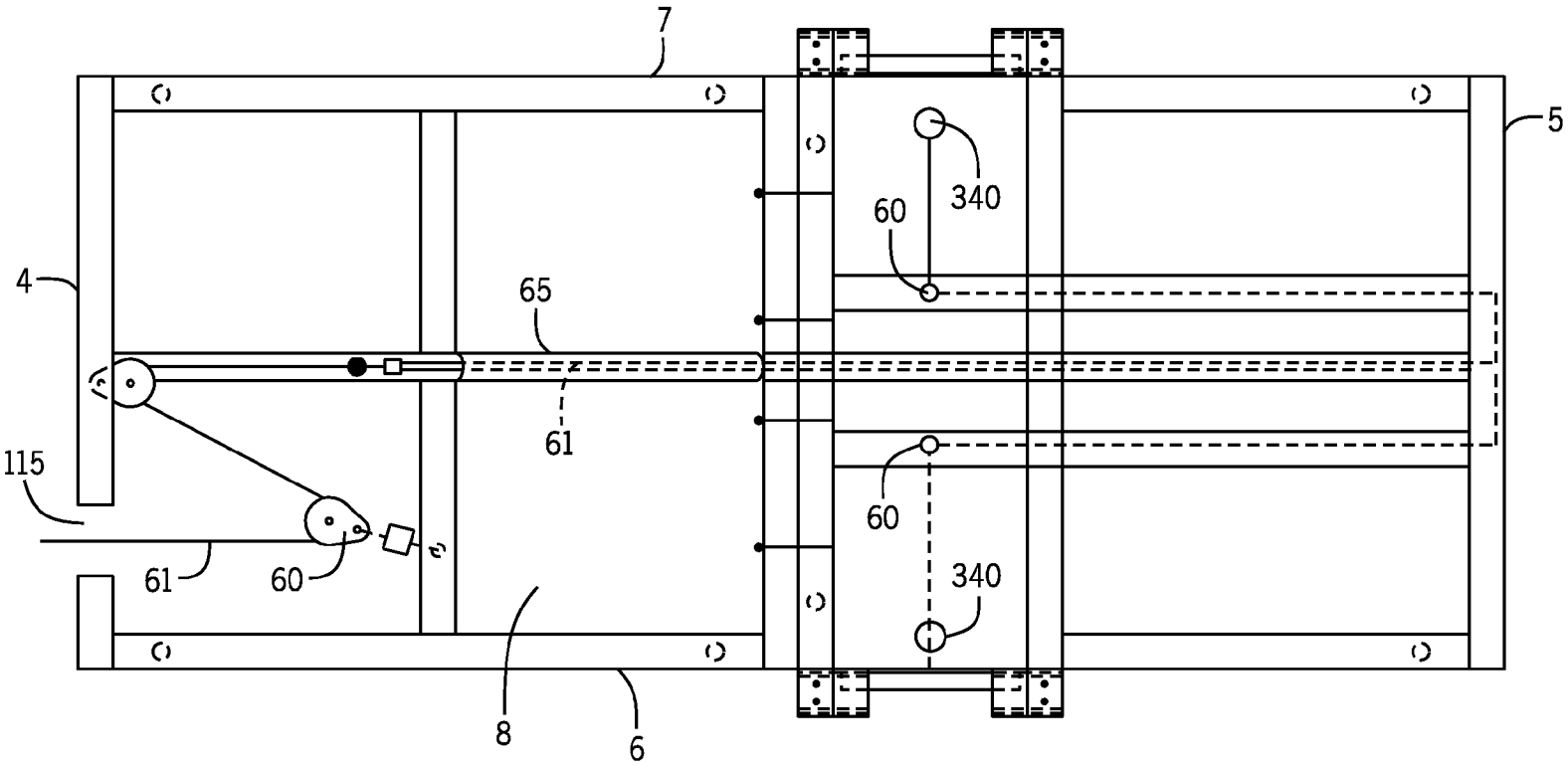
FIG. 2 illustrates a top view of the interior of the generally horizontal platform of the exercise machine.

As stated above, located within the interior 8 of the generally horizontal platform 10 may be at least one internal gear (or pulley) 60 and at least one rope 61. In an embodiment, the rope(s) 61 may pass through internal pipes 65 (FIG. 2). Preferably, the internal pipes 65 are PVC pipes. The internal pipes 65 may restrict the movement of the ropes 61 and therein reduce the chances of the ropes 61 becoming tangled or dislodged within the interior 8 of the generally horizontal platform 10. The internal gear (or pulleys) 60 may redirect the force of the rope(s) 61 wherein the force originates from the rotation of a crank 75 portion of the generally vertical tower portion 20. In particular, the second person 275 may manually turn the crank 75 of the generally vertical tower portion 20 in order to control the ropes 61 located within the interior 8 of the generally horizontal platform 10 wherein the ropes 61 are also secured to the worm/planetary gears 135.

In an embodiment, the generally vertical tower portion 20 may be partially secured to the generally horizontal platform portion 10. In particular, the back 25 of the generally vertical tower portion 20 may be secured to the front 4 of the generally horizontal platform 10 so that the generally vertical tower portion 20 and the generally horizontal platform portion 10, when assembled into the workable device 1, generally form a right angle (FIG. 1).

In an embodiment, an opening 110 (FIG. 3) may be present near the bottom 23 of the generally vertical tower portion 20. Further, in an embodiment, an opening 115 (FIG. 2) may also be present at the front 4 of the generally horizontal platform 10. The opening 110 at the bottom 23 of the generally vertical tower portion 20 may be substantially the same size and shape as the opening 115 of the front 4 of the generally horizontal platform 10 such that the opening 115 of the generally horizontal platform 10 aligns with the opening 110 of the bottom 23 of the vertical tower 20. The opening 115 of the generally horizontal platform 10 and the opening 110 of the generally vertical tower 20 may allow the rope(s) 61 to pass from the vertical tower 20 to the platform 10 such that the force directed from the turning of the crank 75 may be transferred to the ropes 61 which extend out through the top 2 of the generally horizontal platform 10 (as described below).

As stated above, in an embodiment, a manual crank (or wench) 75 may be used in connection with the exercise machine 1. In particular, in an embodiment, the manual crank 75 may be used by the second person 275 (FIG. 5) wherein the second person 275 may alter the resistance while the first person 280 is exercising or training. In an embodiment, the crank 75 may allow the second person 275 to apply a force on the rope 61 equal to approximately a 18:1 ratio. In particular, the second person 275 may turn the crank 75, for example, clockwise, a slight amount to create a large downward pull on the ropes 61 toward the platform 10 while the first person 280 is pushing up on the bar, handles, straps, hooks or the like 225 to counter the downward pulling of the bar, handles, straps, hooks or the like 225.

In an alternative embodiment, a locking device 80 (FIG. 3) may be used in connection with the exercise machine 1. The locking device 80 may allow the second person 275 to lock the resistance of the bar, handles, straps, hooks or the like 225 while the first person 280 is exercising. In particular, in an embodiment, the locking device 80 may simply be a bar which may move from a first position to a second position with respect to the generally vertical tower portion 20. The locking device 80, when extended away from the generally vertical tower portion 20 may prevent the crank 75 from further rotating.

Figure 4:
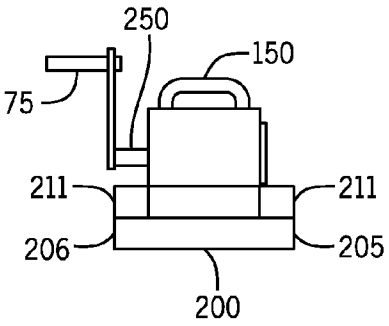
FIG. 4 illustrates a top view of the generally vertical tower of the exercise machine.

In an embodiment, the generally vertical tower portion 20 may have a handle 150 (FIGS. 1 and 4). The handle 150 may stabilize and balance the second person 275 while the second person 275 is operating the crank 75 and while the first person 280 is on the generally horizontal platform 10 performing the exercise.

In an embodiment, the front 24 of the generally vertical tower portion 20 may have a padded portion 200. The padded portion 200 may have a top 201, a bottom 202, a front 203, a back 204, a first side 205 and a second side 206 (FIG. 4). The back 204 of the padded portion 200 may be removably secured to, for example, the front 24 of the generally vertical tower portion 20. The padded portion 200 may protect the first person 280 and/or second person 275 while the device 1 is in use in the event the either person slips or otherwise inadvertently moves forward and contacts the generally vertical tower portion 20. In an embodiment, a spacer 250 (FIG. 3) may be placed at the second side 27 of the generally vertical tower portion 20. The spacer 250 may provide a space for a side padded portion 211 (FIG. 4) which may also protect the first person 280 and/or the second person 275 from injury.

In an embodiment, the rope(s) 61 may have a first end 62 (FIG. 5) and a second end 63 (FIG. 1). The first end 62 of the rope(s) 61 may be secured to, for example, the worm/planetary gears 135 which, in turn, are controlled by the manual crank 75 of the vertical tower 20. The second end 63 of the rope(s) 61 may be temporarily and removeably secured to the bar, handles, straps, hooks or the like 225. In particular, the second end 63 of the rope(s) 61 may be secured to the bar, handles, straps, hooks or the like 225 by, for example, a securing clip (not shown). A user may remove, for example, a weight bar (FIG. 6) and substitute the weight bar for handles (FIG. 8) or an alternative grasping device for performing various other exercises.

As stated above, located within the interior 28 of the generally vertical tower portion 20 may be a plurality of worm/planetary gears 135 (FIG. 3) and belts 136. The plurality of worm/planetary gears 135 and belts 136 may redirect the circular movement of the manual crank 75 located near the top 22 of the vertical tower 20 to the first end 62 of the rope(s) 61 located at the bottom 23 of the generally vertical tower portion 20. As a result, movement of the crank 75 either tightens or loosens the first end 62 of the rope(s) 61 and therein eventually either tightens or loosens the downward force on the bar, handles, straps, hooks or the like 225. Upon the second person 275 (the operator) manually engaging and driving the control mechanism via a crank 75, the series of worm/planetary gears 135 may provide approximately an 18:1 mechanical advantage of force.

In an embodiment, at least one opening 340 (FIG. 8) may be present on the top 2 of the generally horizontal platform 10. Preferably, there are two openings 340 located approximately two to four feet apart. The openings 340 may be located near, for example, approximately half-way between the front 4 and the back 5 of the generally horizontal platform 10 so as to provide the most stable exercise training for the first person 280. The openings 340 may allow the rope(s) 61 (which pass through the interior 8 of the generally horizontal platform 10) to exit the interior 8 of the platform 10 and to extend upward, away from the generally horizontal platform 10. Although the exact amount of rope(s) 61 extending outside of the generally horizontal platform 10 may vary, preferably, the rope(s) 61 extend anywhere from one foot outside the interior 8 of the platform 10 to approximately ten feet outside the interior 8 of the platform 10. Extending the rope(s) 61 outside the interior 8 of the platform 10 allows the user to grasp the bar, handles, straps, hooks or the like 225 secured to the second end 63 of the rope(s) 61 to therein perform exercises.

In an embodiment, the bottom 3 of the generally horizontal platform 10 may have a plurality of independently adjustable feet 255. The plurality of adjustable feet 255 may allow the device 1 to be properly leveled on a floor or may allow a user to utilize the exercise machine in an inclined manner (not shown). Further, in an embodiment, the adjustable feet 255 may also have a padded region (not shown) which protects the floor from scratches.

The main benefit of the present exercise machine 1 is that, if the first person 280 accidentally slips or must otherwise stop providing the upward pushing force against the bar, handles, straps, hooks or the like 225, the only downward pressure would be the actual weight of the bar, handles, straps, hooks or the like 225 and a portion of the ropes 61. More specifically, in a normal weight bench, if the first person 280 could not support the weight of the weight bar, the weight bar would come crashing down on the person if the person did not have proper spotters. Further, in weight benches having a twisting locking device, the safety stops at the bottom of those benches often prevent the person from bringing the weight bar fully down to his/her chest.

In the present exercise machine 1, if the person exercising 280 cannot support the pressure of the bar, handles, straps, hooks or the like 225 and stops pushing upward, the force downward is very minimal; limited to the actual weight of the bar, handles, straps, hooks or the like 225 and a portion of the ropes 61. Thus, a person exercising may only have to support approximately ten to twenty pounds of downward pressure as opposed to a normal weight bench wherein a user would have the constant weight of, for example, a couple hundred pounds pulling down on the person by gravity. As a result, the present exercise machine 1 is substantially safer than traditional weight benches. More specifically, the downward force of the bar, handles, straps, hooks or the like 225 is predominately generated from the downward pulling of the ropes 61 and not from gravity.

When using the device 1, the first person 280 may assume a multitude of body positions either free-standing or supported via support mechanism 285 (FIG. 5) such as, for example, a flat bench, a chair, an inclined bench, a declined bench, a stool or a Roman chair. The first person 280 may select between the interchangeable bar, handles, straps, hooks or the like 225 in order to exploit the external force initially generated by the second person 275 to provide the unique and safe means of evoking meaningful stimulation to ultimately efficiently achieve skeletal muscular adaptation and/or hypertrophy.

The first person 280 may simply and safely pre-determine the intensity of stimulus experienced. For example, the first person 280 (such as a rehab client) may limit the intensity of exertion to, for example, thirty percent (30%) of perceive maximum; therefore the first person 280 may elect to only push back into the bar, handles, straps, hooks or the like 225 with their pre-determined thirty percent (30%) of perceived max intensity level. Alternatively, the first person 280 may desire to efficiently evoke muscular hypertrophy and may therein elect to exert, for example, one hundred percent (100%) of their perceived maximum. The exercise machine 1 in-part exploits Newton's 3rd Law of Motion: for every force there's and equal and opposing force. Due to this very law, once the first person 280 decides to reduce his or her exertion to zero, there is virtually no opposing force, therefore the safety of the device 1 is unparalleled and substantially safer than any other piece of resistive equipment presently on the market. In addition, a user may electively intermittingly push upward on the bar, handles, straps, hooks or the like 225 and then rest without the risk of injury from the force of the bar, handles, straps, hooks or the like 225 crashing down upon the user.

In addition, the first person 280 may elect to consistently or intermittently push back into the bar, handles, straps, hooks or the like 225 while the trainer has control of: the velocity of travel of the bar, handles, straps, hooks or the like 225; distance of travel of the bar, handles, straps, hooks or the like 225 and direction of travel of the bar, handles, straps, hooks or the like 225.

Referring now to FIG. 6, as illustrated from the back, in a method of using the device 1, the first person 280 may push upward (Force B) as the bar, handles, straps, hooks or the like 225 is forced downward (Force A). In particular, the first person 280 may push upward at a pressure equal to the downward force (Force A) applied by the second person 275 (not illustrated in FIG. 6). The downward force (Force A) is predominately created by the second person 275 manually turning the crank 75 which pulls the rope 61 and therein bar, handles, straps, hooks or the like 225 downward, as opposed to, for example, a person placing weights on a weight bar and pushing up against gravity. As a result, if the first person 280 were to suddenly stop pushing upward (Force B), the downward force (Force A) would substantially stop (aside from the negligible physical weight of a portion of the ropes 61 and the light weight bar, handles, straps, hooks or the like 225). Of course, for the first person 280 to push upward (Force B) at a force equal to the downward force (Force A) on the ropes 61 any slack in the ropes 61 would need to be removed and the ropes 61 would need to be tight. As further illustrated in FIG. 6, in an embodiment, two ropes 61 may extend upward from the platform 10 and may attach to each side of the bar, handles, straps, hooks or the like 225 and wherein the bar, handles, straps, hooks or the like 225 may substantially extend across the platform 10, from the first side 6 to the second side 7 of the device 1.

Figure 7:
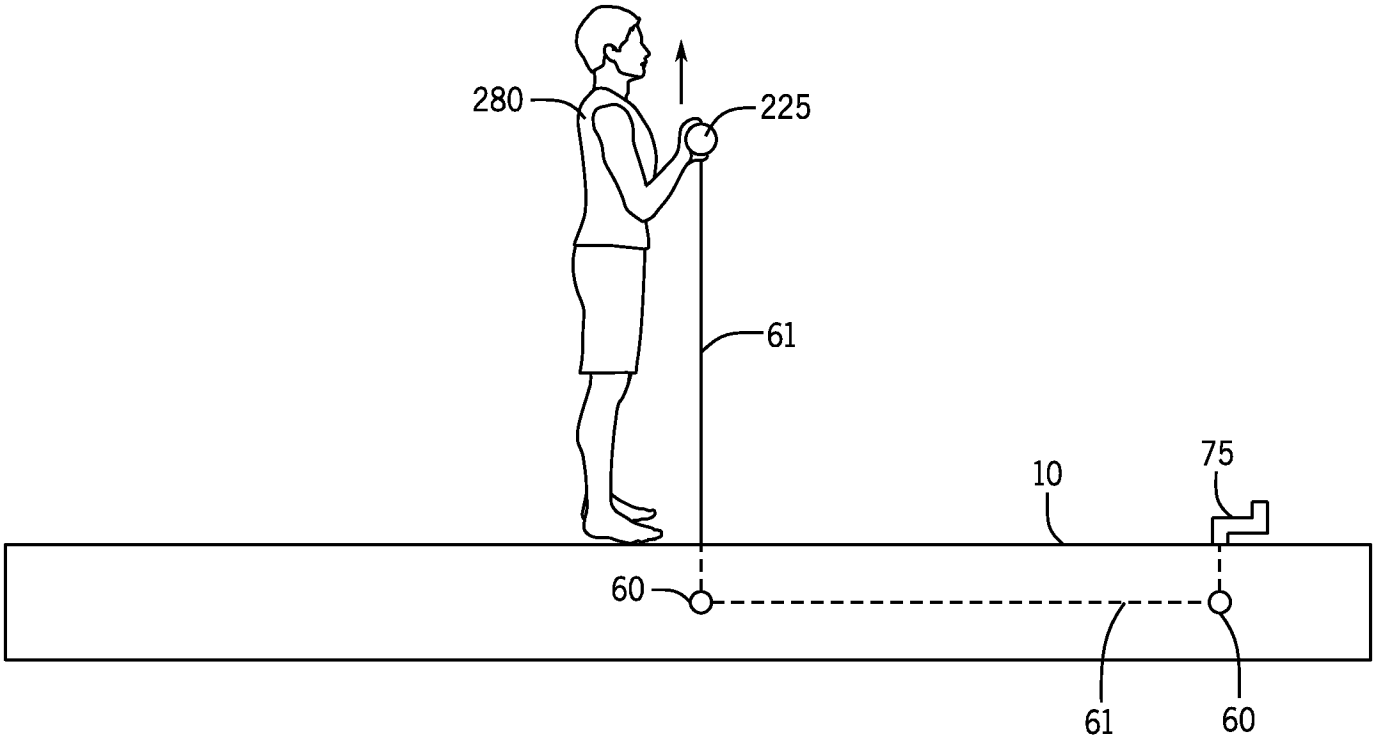
FIG. 7 illustrates an alternative embodiment wherein the exercise machine lacks a vertical tower and wherein a manual resistance crank operated by a second person is located on the top of the generally horizontal platform of the exercise machine.

Referring now to FIG. 7, in an alternative embodiment, the vertical tower 20 portion may be removed and the device may simply operate as a platform 10 having the remaining elements. In particular, the manual crank 75 may be located on, for example, the top 2 of the platform 10. Finally, referring now to FIG. 8, a top view of the device 1 is provided. In this figure, handles 225 are secured to the ropes 61 as opposed to a bar 225 as shown in FIG. 6.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

The invention claimed is:

1. An exercise machine comprising:

a platform forming a housing wherein the platform has a top, a bottom, a front, a back, a first side, a second side and an interior;

at least one rope, strap or chain located within the interior of the platform wherein the rope, strap or chain has a first end and a second end;

at least one gear located within the interior of the platform wherein the rope, strap or chain is in contact with the gear and wherein the gear alters the direction of the rope, strap or chain within the interior of the platform;

at least one opening located on the top of the platform wherein the rope, strap or chain extends from within the interior of the platform and partially out of the opening on the top of the platform such that the second end of the rope, strap or chain is located on the top of the platform;

wherein the first end of the rope, strap or chain is controlled by a manual crank; and wherein during use a first person is positioned on the top of the platform and wherein a second person controls the manual crank so that a downward force is applied to the rope, strap or chain and pulls the rope, strap or chain downward toward the top of the platform and wherein the first person pushes upward on the rope, strap or chain to perform an exercise.

2. The exercise machine of claim 1 further comprising:

a bar, handle, strap or hook secured to the second end of the rope, strap or chain wherein the first person grasps the bar, handle, strap or hook and pushes the bar, handle, strap or hook in an upward, vertical manner with respect to the platform.

3. The exercise machine of claim 1 further comprising:

a second housing wherein the second housing has a top, a bottom, a front, a back, a first side, a second side and an interior and wherein the second housing is secured to the platform housing wherein the second housing is generally in a vertical orientation with respect to the platform housing which is generally in a horizontal orientation and wherein the second housing and the platform housing form a right angle.

4. The exercise machine of claim 1 further comprising:

a slip resistant tape secured to the top of the platform housing.

5. The exercise machine of claim 1 further comprising:

a plurality of adjustable feet secured to the bottom of the platform housing wherein each of the plurality of adjustable feet may be adjusted independently to level the platform housing.

6. The exercise machine of claim 3 further comprising:

a pad secured to an exterior of the second housing.

7. The exercise machine of claim 3 further comprising:

a handle secured to the second housing for stabilizing the second person.

8. The exercise machine of claim 3 further comprising:

a plurality of worm or planetary gears located within the interior of the second housing; and a plurality of belts located within the interior of the second housing wherein turning of the manual crank by the second person controls the movement of the plurality of worm or planetary gears and the movement of the plurality of belts of the interior of the second housing and wherein movement of the plurality of worm or planetary gears and the movement of the plurality of belts pulls the second end of the rope, strap or chain downward toward the top of the platform housing.

9. The exercise machine of claim 1 further comprising:

a pipe having an interior located within the interior of the housing of the platform wherein the rope, strap or chain passes through the interior of the pipe and wherein the pipe keeps the rope, strap or chain substantially in a straight line and therein prevents the rope, strap or chain from becoming tangled.

10. A method of exercising comprising:

providing a platform forming a housing wherein the platform has a top, a bottom, a front, a back, a first side, a second side and an interior;

providing at least one rope, strap or chain located within the interior of the platform wherein the rope, strap or chain has a first end and a second end;

providing at least one gear located within the interior of the platform wherein the rope, strap or chain is in contact with the gear and wherein the gear alters the direction of the rope, strap or chain within the interior of the platform;

providing at least one opening located on the top of the platform wherein the rope, strap or chain extends from within the interior of the platform and partially out of the opening on the top of the platform such that the second end of the rope, strap or chain is located on the top of the platform;

wherein the first end of the rope, strap or chain is controlled by a manual crank;

wherein a first person is positioned on the top of the platform and wherein a second person controls the manual crank so that a downward force is applied to the rope, strap or chain and pulls the rope, strap or chain downward toward the top of the platform and wherein the first person pushes upward on the rope, strap or chain to perform an exercise; and wherein the force generated by the second person using the manual crank to pull the rope, strap or chain downward toward the top of the housing plus the negligible weight of the rope, strap or chain is equaled by the first person pushing upward on the rope, strap or chain upward to counter the downward force.

11. The method of exercising of claim 10 wherein turning of the manual crank by the second person creates an 18:1 ratio movement of the second end of the rope, strap or chain.

* * * * *